US006182788B1

(12) United States Patent
Senior

(10) Patent No.: US 6,182,788 B1
(45) Date of Patent: Feb. 6, 2001

(54) ELEVATING WORK PLATFORM

(75) Inventor: Neil James Senior, Main Beach (AU)

(73) Assignee: Holt Industries PTY Ltd., Queensland (AU)

( * ) Notice: Under 35 U.S.C. 154(b), the term of this patent shall be extended for 0 days.

(21) Appl. No.: 09/230,968

(22) PCT Filed: Aug. 4, 1997

(86) PCT No.: PCT/AU97/00489

§ 371 Date: Feb. 2, 1999

§ 102(e) Date: Feb. 2, 1999

(87) PCT Pub. No.: WO98/05583

PCT Pub. Date: Feb. 12, 1998

(30) Foreign Application Priority Data

Aug. 2, 1996 (AU) ..... PO1395
Nov. 29, 1996 (AU) ..... PO3920

(51) Int. Cl.[7] ..... B66F 11/00
(52) U.S. Cl. ..... 182/2.8; 182/2.3
(58) Field of Search ..... 182/2.1–2.11, 69.6, 182/63.1

(56) References Cited

U.S. PATENT DOCUMENTS 3,056,465 * 10/1962 Gerrans ..... 182/2.3
3,804,207 * 4/1974 Stonebraker ..... 182/2.3
4,646,875 * 3/1987 Sholl .
5,211,526 5/1993 Robinettee .
5,439,343 8/1995 Watson .
5,551,527 * 9/1996 Luscombe ..... 182/2.3
5,868,218 * 2/1999 Lawson ..... 182/2.3

FOREIGN PATENT DOCUMENTS

15723/83 11/1983 (AU) .
46431/85 2/1986 (AU) .
53452/90 9/1990 (AU) .
71164/91 8/1991 (AU) .
99 485 6/1983 (EP) .
27027522 3/1917 (FR) .
2138390 10/1984 (GB) .
WO 93/12029 6/1993 (WO) .

* cited by examiner

*Primary Examiner*—Alvin Chin-Shue
(74) *Attorney, Agent, or Firm*—Mathews, Collins, Shepherd & Gould P.A.

(57) ABSTRACT

An elevating work platform unit is mountable on, and de-mountable from, a vehicle. A counter leverage arm assembly is connectable to the vehicle to provide vertical stability for the mast which supports a boom and platform for luffing and/or slewing movement.

16 Claims, 10 Drawing Sheets

ELEVATING WORK PLATFORM

BACKGROUND OF THE INVENTION

1. Field of the Invention

This invention relates to an elevating work platform.

The platform is particularly suitable for, but not limited to, a work platform mountable on vehicles such as utility vehicles or pickups, vans, light trucks or the like. The term "work platform" shall be used throughout the specification (ie., description and claims) to also include cranes and "cherry-picker" type materials handing equipment.

2. Prior Art

Examples of elevating work platforms are manufactured and sold under the U.S. Registered Trade Mark "DUR-A-LIFT" by Dur-a-Lift Inc., of George, Iowa, U.S.A.

These platforms suffer some, if not all, of the problems of known elevating work platforms mounted on light vehicles.

With most known platforms, the arrangements for mounting are complicated, expensive and/or space consuming. When the platforms are mounted, they usually do not allow a large working area in the vehicle. Finally, the platforms are not arranged for easy mounting onto standard vehicles without some interference or requirement for major modification to the vehicles. This means that the platforms are also not readily demountable so that the vehicles can be readily used for other tasks.

SUMMARY OF THE INVENTION

It is an object of the present invention to minimise, or ameliorate, at least one of the problems with known platforms.

In one aspect, the present invention resides in an elevating work platform unit, mountable on a vehicle, including:

- a support frame on, or mountable on, the vehicle;
- a base frame having a mast supporting a boom for luffing and/or slewing movement relative to the base frame or mast;
- coupling means enabling releasable coupling of the base frame to the support frame; and
- bracing means on the base frame and/or mast releasably connectable to the vehicle to provide at least vertical stability to the mast.

In one embodiment, the support frame is, or is incorporated in, a towbar at the rear of the vehicle. In an alternative embodiment, the support frame is a load deck or chassis of the vehicle, preferably immediately rearwardly of an operator's cab on the vehicle.

In a first embodiment, the base frame is preferably a substantially horizontal beam or frame member arranged to extend substantially transversely to the longitudinal axis of the vehicle. In the alternative embodiment, the base frame is preferably a base plate on the mast.

Preferably, the coupling means for the first embodiment includes a socket or tongue on the support frame releasably engageable by a complementary spigot, socket or yoke on the base frame. In the alternative embodiment, the coupling means may be releasable fasteners.

The bracing means may include a counter leverage arm releasably interconnecting the mast (or base frame) to the vehicle at a fixing point spaced from the support frame, the counter leverage arm providing vertical stability to the mast when the base frame and/or mast are in tension or compression.

In a van, an internal brace may be provided between the floor and the roof, the counter leverage arm being engageable with the internal brace.

Diagonal braces may be provided between the base frame and the mast.

The boom may be a fixed-length, single- or two-stage telescopic, fly- or knuckle-boom and be provided with a work platform or load-engaging hook at its distal end.

Preferably, the boom is hingedly mounted on a post rotatably journalled in the mast, where a hydraulic ram is operable to raise and lower the boom in a luffing movement.

A second hydraulic ram may interconnect the post to the base frame to move the boom with a slewing movement.

In a second aspect, the present invention resides in a vehicle fitted with the platform unit.

BRIEF DESCRIPTION OF THE DRAWINGS

To enable the invention to be fully understood, preferred embodiments will now be described with reference to the accompanying drawings, in which.

DETAILED DESCRIPTION OF THE PREFERRED EMBODIMENTS

Figure 1:
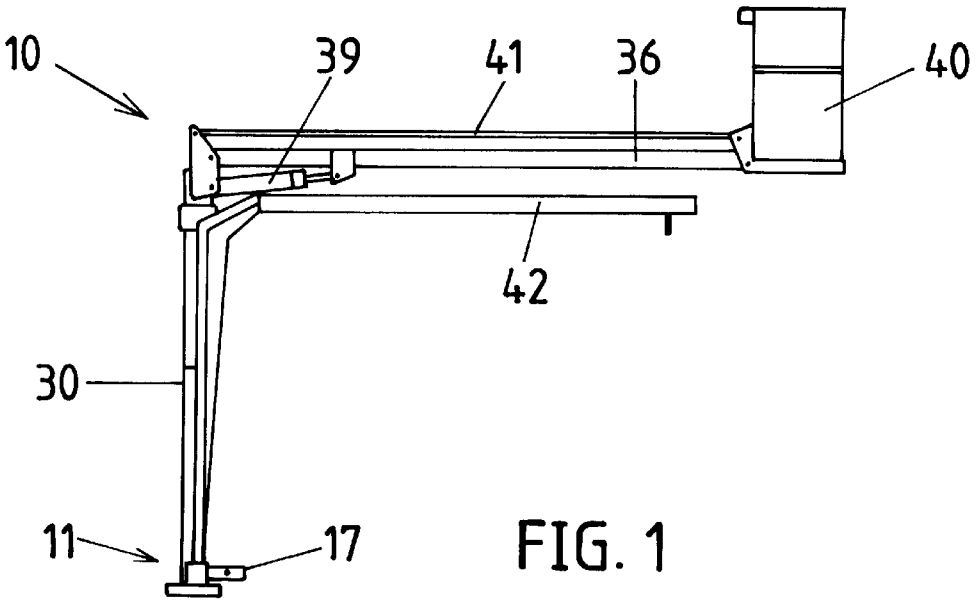
FIG. 1 is a side view of one embodiment of the platform unit before fitting to a vehicle.
Figure 3:
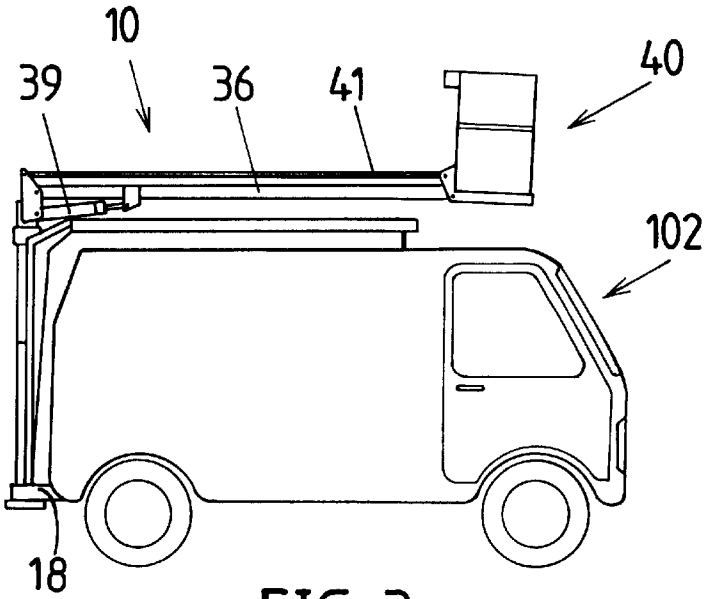
FIGS. 2 and 3 show the platform unit fitted to a light truck and van respectively, with the boom at its lowered position.
Figure 2:
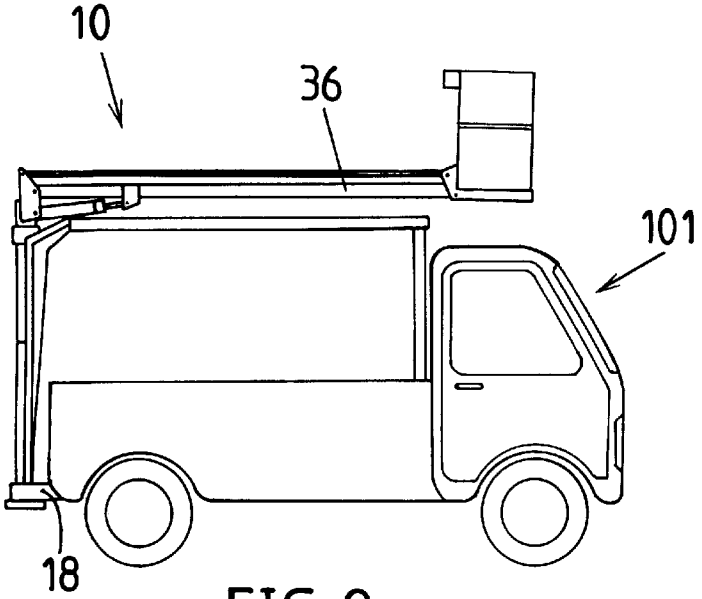
Figure 4:
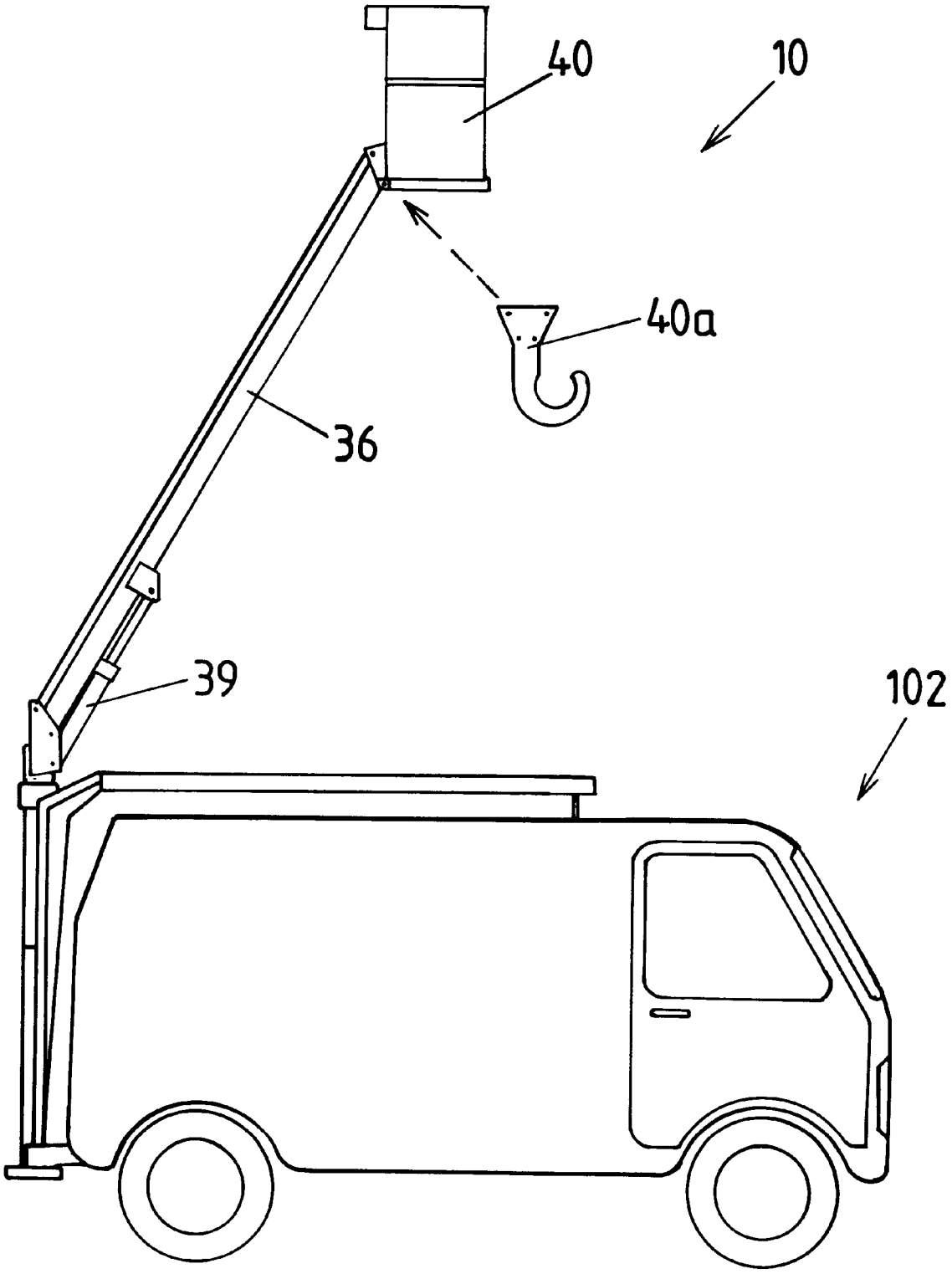
FIG. 4 corresponds to FIG. 3 with boom at its raised position.
Figure 5:
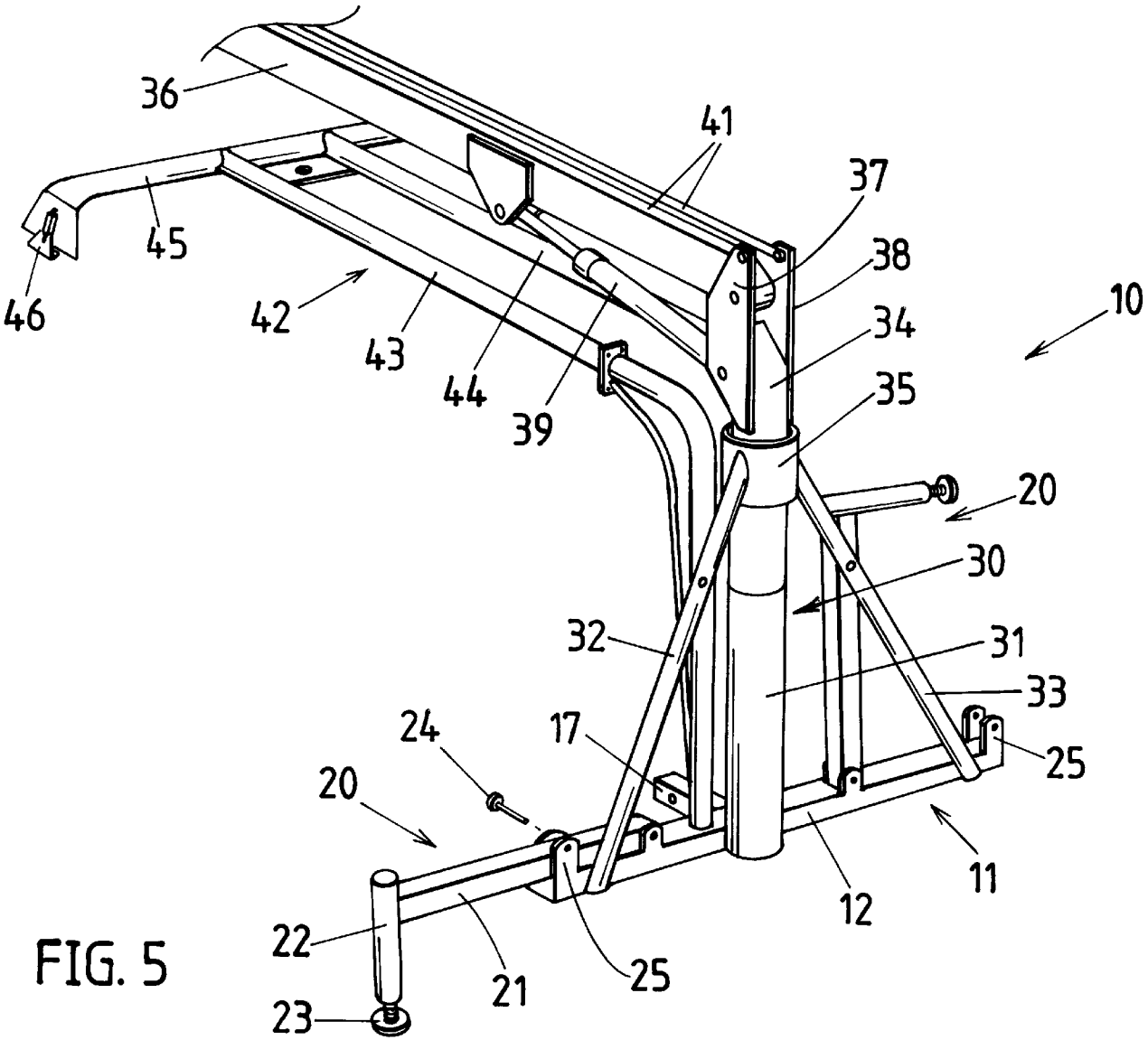
FIG. 5 is a rear perspective view of the platform unit.

Referring to FIG. 1, the platform unit 10 is shown prior to mounting on the support frame at the rear of a vehicle, which may be a light truck 101 (or utility or pick-up) (see FIG. 2) or a van 102 (FIGS. 3 and 4). As shown in more detail in FIG. 5, the unit 10 has a base frame 11 with a horizontal beam 12 arranged to extend transversely to the longitudinal axis of the vehicle on which it is mounted.

Figure 6:
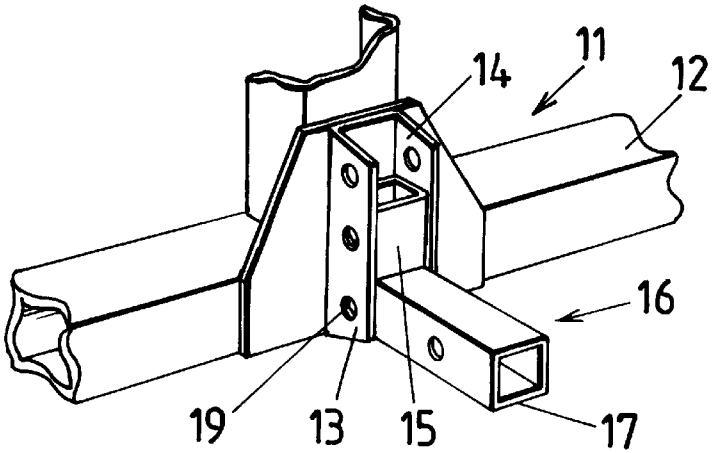
FIG. 6 is a perspective view of the base frame with one example of a coupling member.

A pair of spaced, vertical mounting plates 13, 14 (see FIG. 6) adjustably receive a vertical post 15 of a coupling member 16 having a horizontal spigot 17 adapted to be releasably engaged in a socket on a tow-bar 18 on the vehicle 101, 102.

Figure 7:
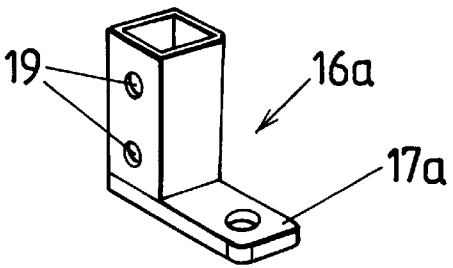
FIG. 7 is a perspective view of an alternative coupling member.

(In an alternative embodiment—see FIG. 7—the spigot 17 is replaced by a tongue 17*a* on a coupling 16*a*, the tongue 17*a* being bolted to a tongue on the tow bar 18.)

The holes 19 in the plates 13, 14 on the base frame 11 and in the posts 15, 15*a* on the coupling members 16, 16*a* allow the height of the mounting of the unit 10 on the vehicles 101, 102 to be selectively adjusted.

A pair of stabilizers 20 (see FIG. 5) have extension arms 21 hingedly mounted on the beam 12 and have mechanical (or hydraulic) jacks 22 with feet 23. The extension arms 21 can be locked on the lowered position by pins 24 engaged in brackets 25. As shown, the stabilizers 20 may be raised for transport. (In an alternative embodiment not shown, the stabilizers 20 can be releasably clipped or otherwise mounted on the beam and be detachable for transport.)

A mast assembly 30 has a tubular body 31 extending vertically upwards from the beam 12, and is braced by a pair of inclined braces 32, 33, and a mast post 34 is rotatably journalled in the mast body 31 and support collar 35 A boom 36 is pivotally mounted between a pair of plates 37, 38 at the upper end of the mast post 34 and can be luffed between a lowered position (see FIG. 4) and a raised position (see FIG. 4) by a hydraulic ram 39. A work platform 40 is provided at the distal end of the boom 36, and is held in a fixed inclination relative to the mast 30 by a pair of ties or links 41. By rotation of the mast post 34 relative to the mast body 31, and selective extension or retraction of the ram 39, the boom 36 (and thereby work platform 40) can undergo a range of luffing and/or slewing movements relative to the mast 30 (and thereby the vehicle 101, 102).

As illustrated in dashed lines on FIG. 4, the work platform 40 may be replaced by a crane- or materials-handling hook 40*a*.

To provide vertical stability to the mast 30, a counter leverage arm assembly 42 (see FIG. 5) has a pair of spaced, inverted L-shaped arms 43, 44 fixed to the beam 12 (and/or collar 35). The forward ends of the arms 43, 44 are connected to a cross-bar 45 which has end clamps 46 engageable with the rain gutter (not shown) on the roof of the van 102.

Figure 8:
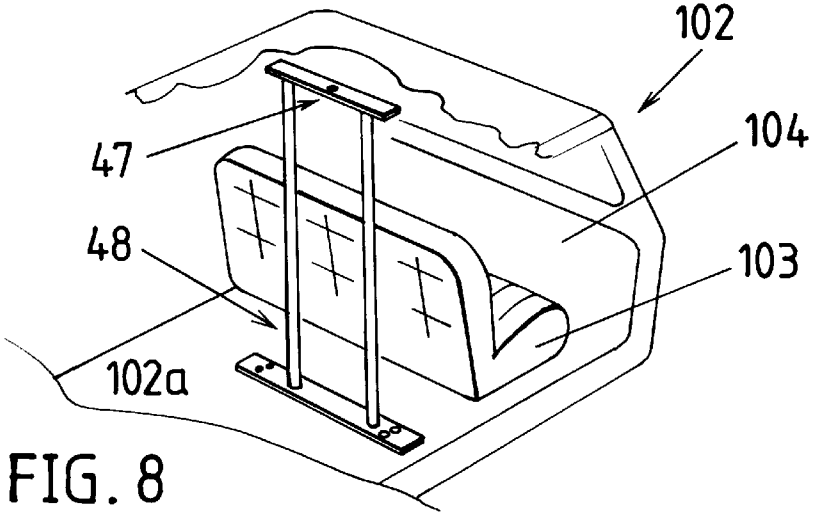
FIG. 8 is a perspective view of an interior brace for the van of FIGS. 3 and 4.

In an alternative embodiment, the forward ends of the arms 43, 44 may be bolted to the top bar 44 of a bracing unit 48 (see FIG. 8) bolted to the floor 102*a* of the van 102 immediately behind the seat(s) 103 in the driver's compartment 104.

Figure 9:
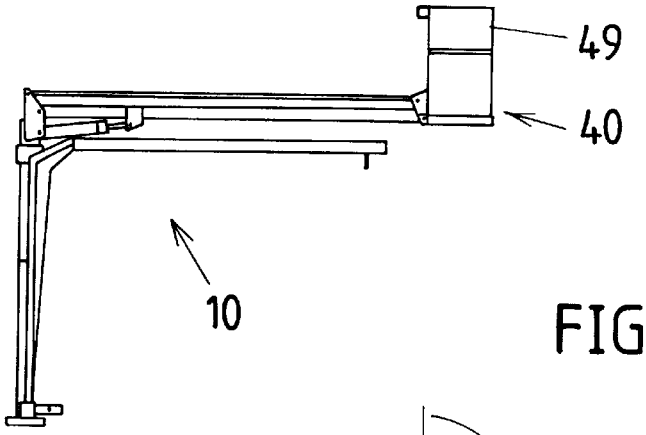
FIGS. 9 and 10 are side views of the platform unit with the handrails raised and lowered.
Figure 10:
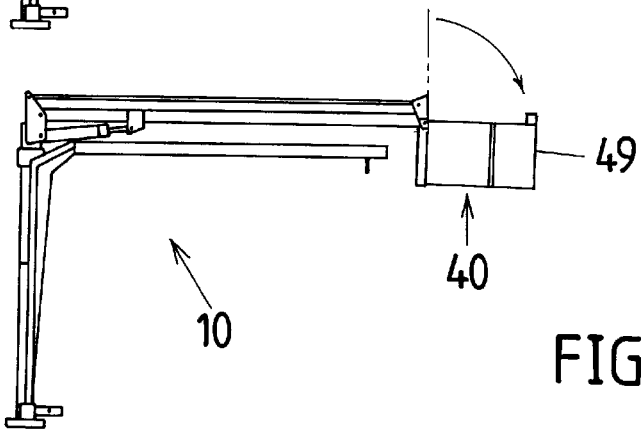

To minimise drag and to lower the travelling height of the platform unit 10, the railings 49 of the work platform 40 may be hinged downwardly—see FIGS. 9 and 10.

Figure 11:
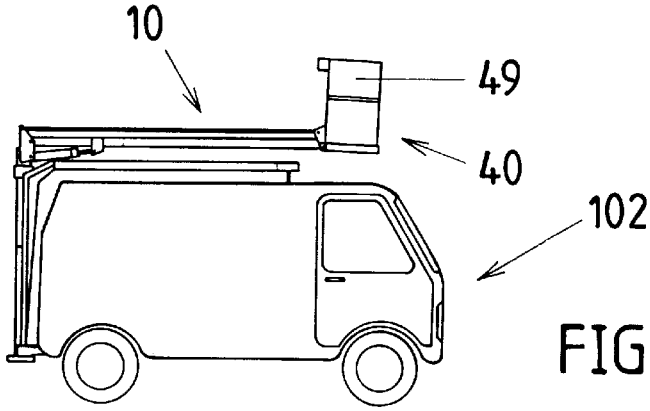
FIGS. 11 to 13 correspond to FIGS. 9 and 10, with the platform unit fitted to a van.
Figure 12:
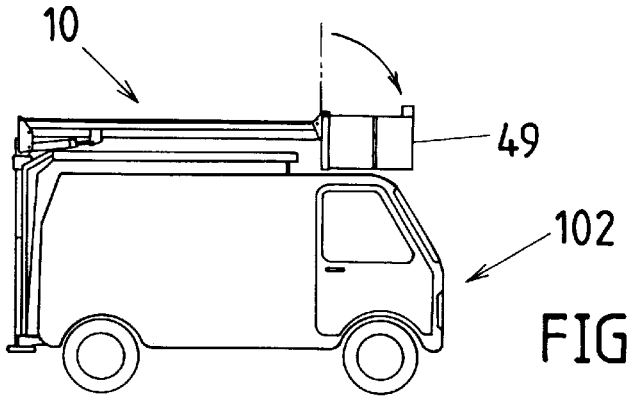
Figure 13:
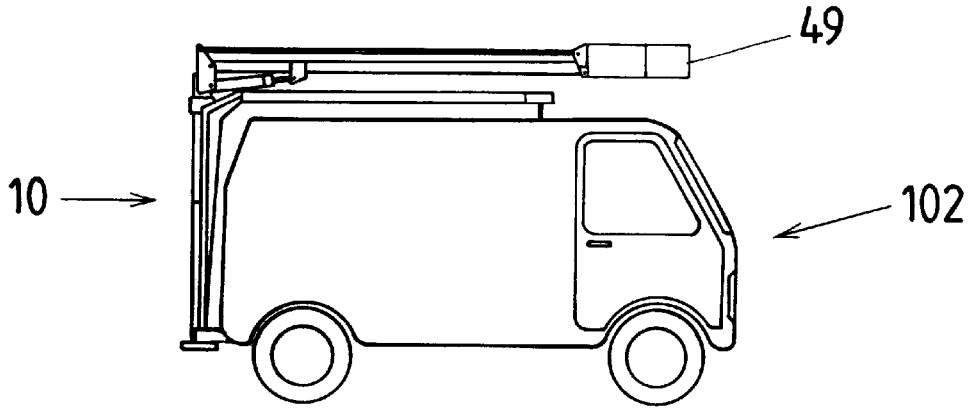
Figure 23:
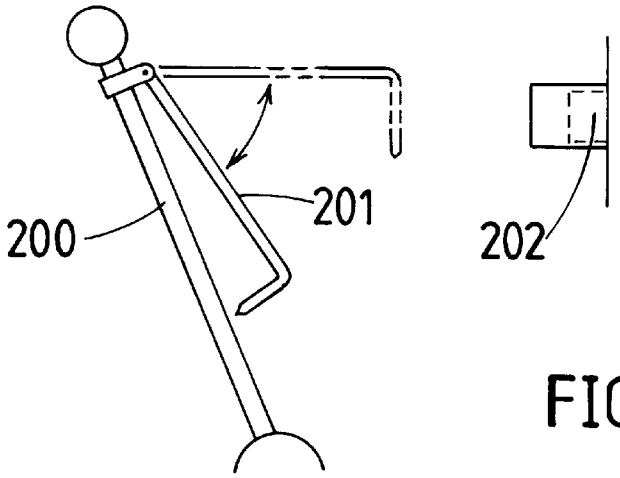
FIGS. 23 and 24 are schematic side views of a gear lever safety interlock system.
Figure 24:
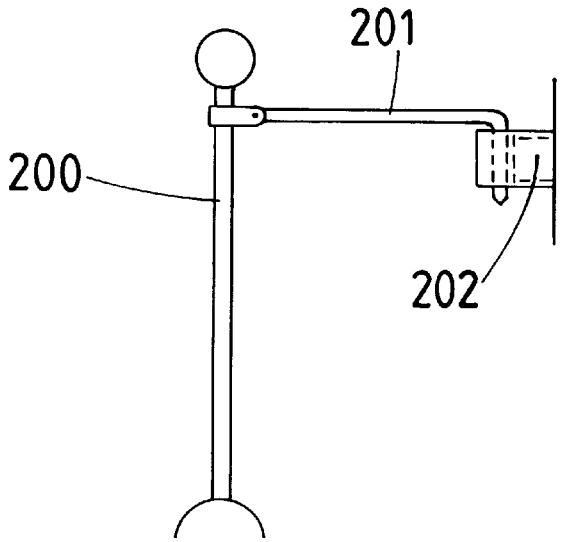
Figure 14:
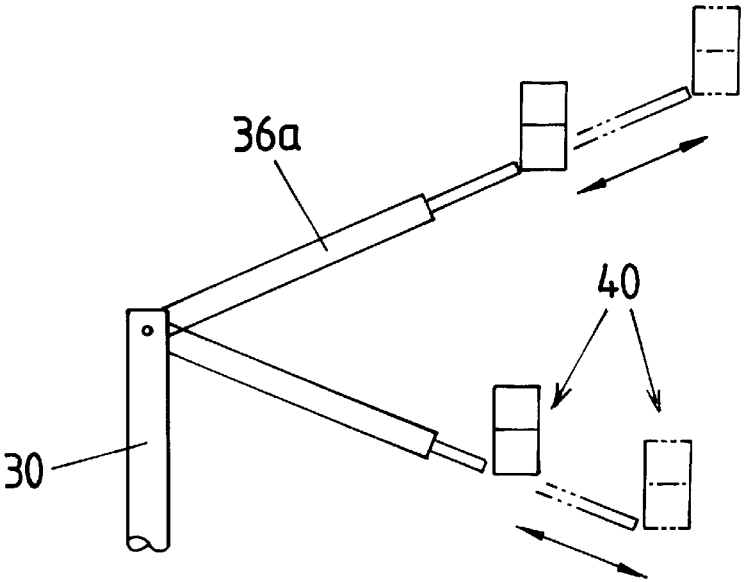
FIG. 14 is a schematic side view of a telescopic boom for the platform unit.

As shown in FIGS. 11 and 12, there may be insufficient clearance between the work platform 40 and the van 102 (or truck) to enable the railings 49 to be simply moved downwardly—this is overcome as shown in FIG. 13 by making the railings 49 foldable.

Figure 17:
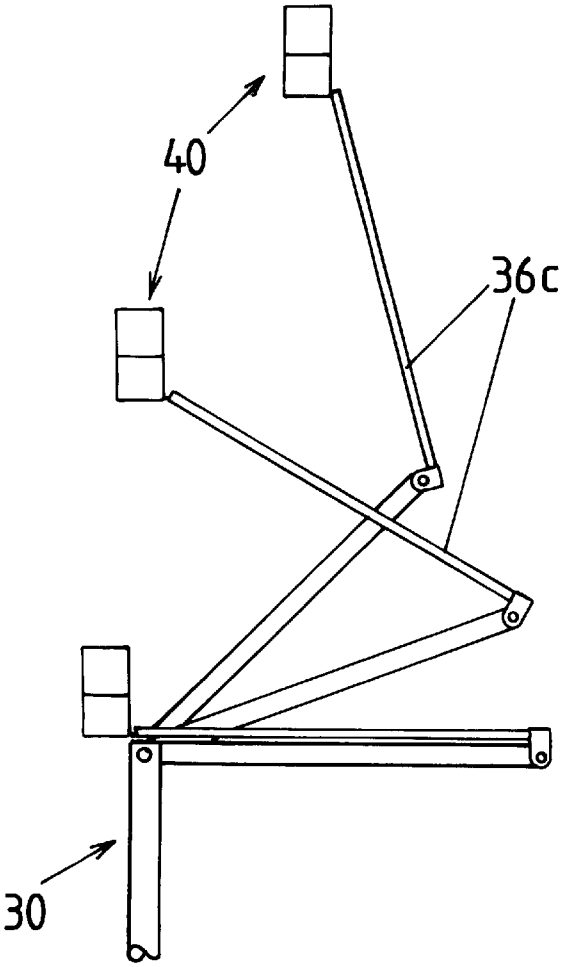
FIG. 17 is a schematic view of a knuckle boom in three alternative luffing positions.

As illustrated in FIGS. 14 to 17, the platform unit 10 may be made even more flexible in its potential applications where the boom 36 is a single-stage telescopic boom 36*a* (see FIG. 14), or a fly boom 36*b* (see FIGS. 15 and 16) or a knuckle-boom 36*c* (see FIG. 17).

Figure 15:
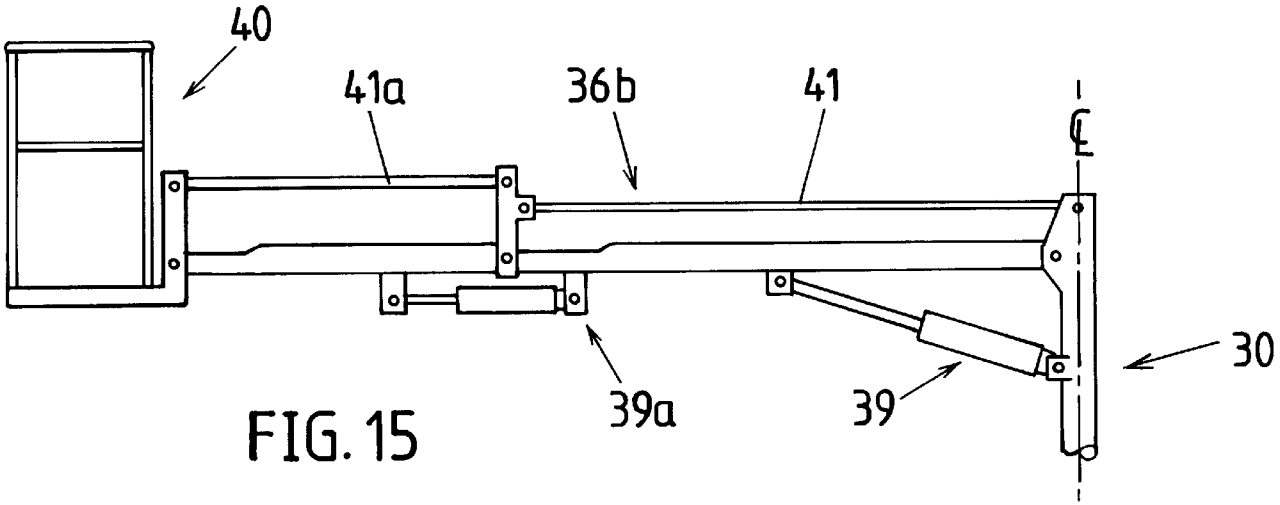
FIG. 15 is a side view of a fly boom.
Figure 16:
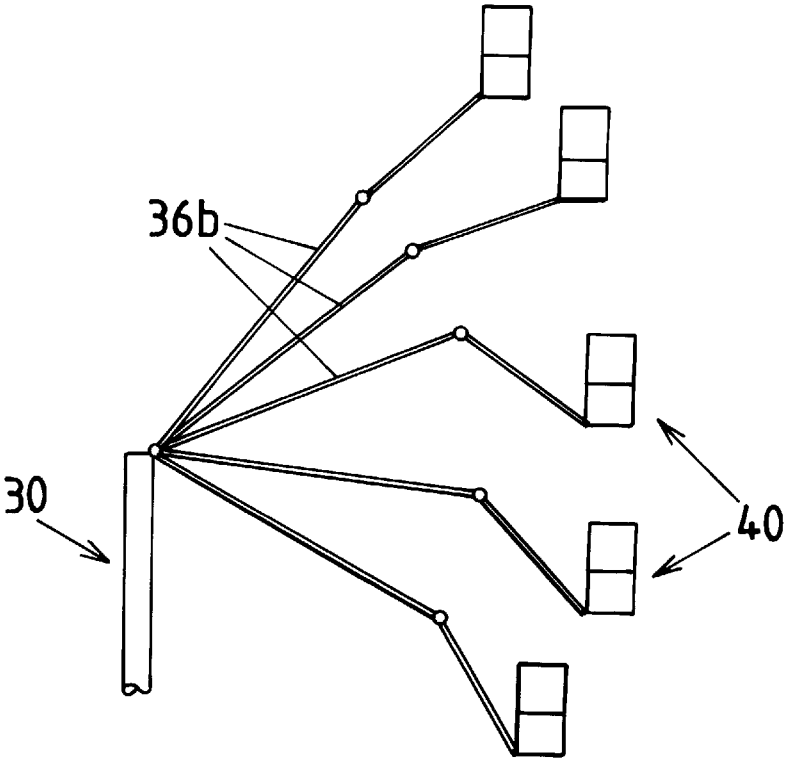
FIG. 16 is a schematic side view of the fly boom for the platform unit in five alternative luffing positions.

With the fly boom 36*b* of FIGS. 15 and 16, primary ram 39 and secondary ram 39*a* control the luffing of the boom 36*b* relative to the vehicle, where links 41, 41 a maintain the attitude of the platform 40.

The slewing movement of the boom 36 relative to the mast 30 can be controlled manually by a mechanical jack; by an electric motor or a rotary hydraulic motor. However, the latter two options are expensive.

Figure 18:
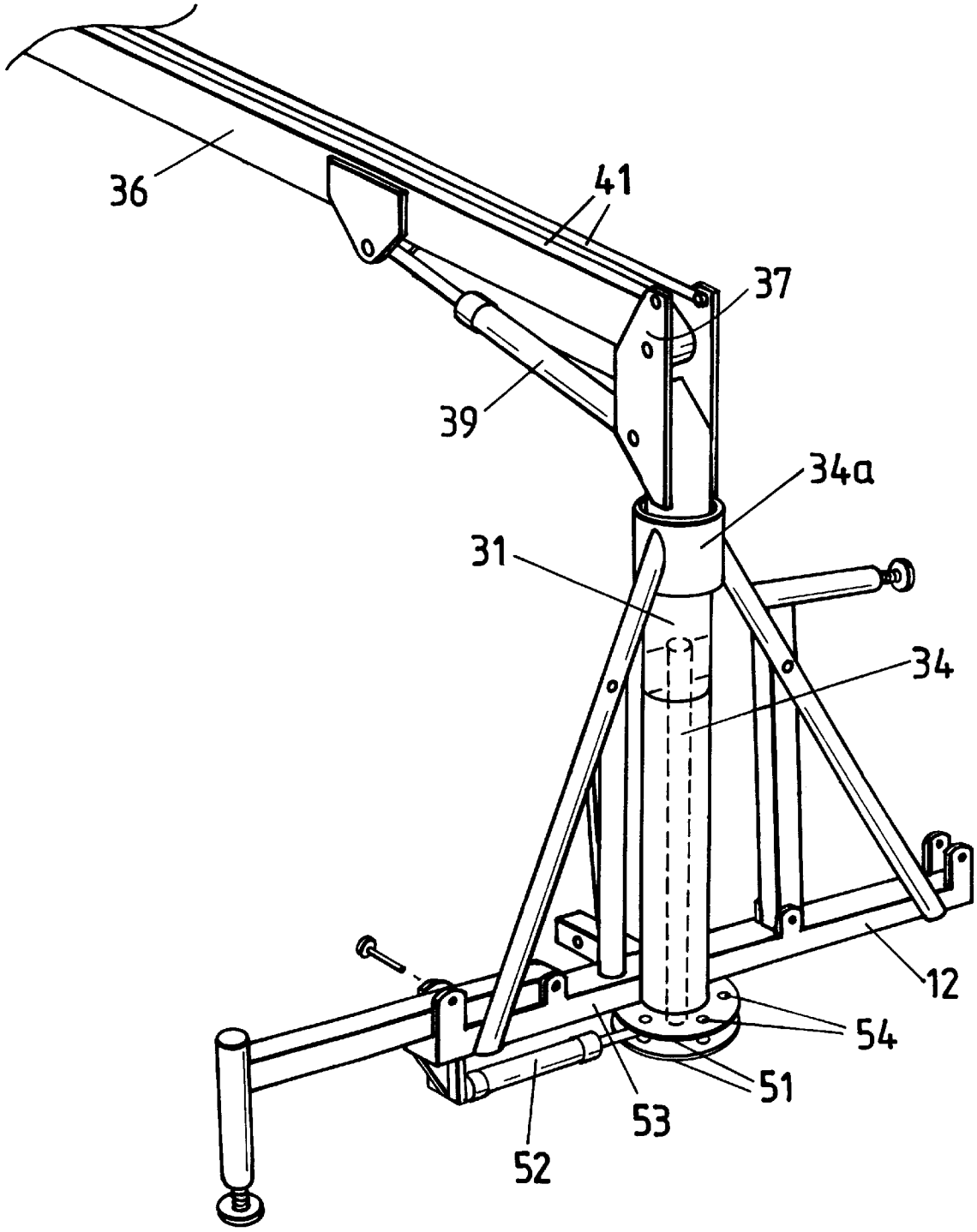
FIG. 18 is a rear perspective view of a second preferred embodiment of the platform unit.

In the embodiment shown in FIG. 18, a pair of cam plates 51 are fixed to the lower end of the mast post 34 journalled in the mast body 31, which is connected to an upper mast body portion 34*a* on which the boom 36 is hingedly mounted. A slewing ram 52 is mounted on the beam 12 and its piston rod 53 is releasably connectable to the cam plates 51 via a pin releasably received in holes 54. By advancing or retracting the slewing ram 52, the cam plates 51 and thereby the mast post 31 and the upper mast portion 31*a* (and thereby boom 36) can be rotated, eg., through 45°, 60° or 90°. For large slewing angles, the piston rod 53 can be selectively connected to the cam plates 51 to effect the slewing in steps.

Figure 19:
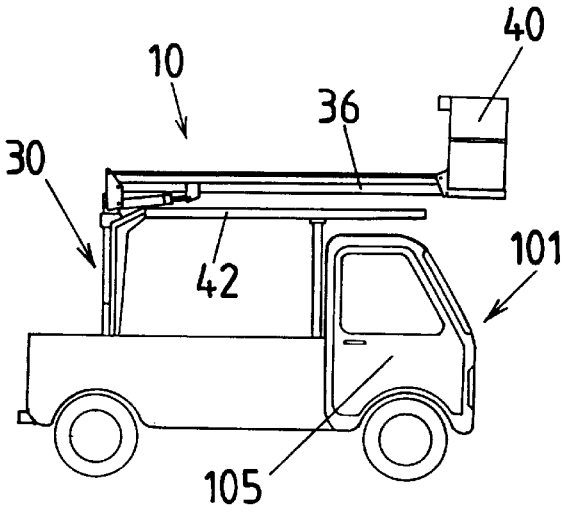
FIGS. 19 and 20 are side views of a third embodiment of the platform unit mounted on a light truck.
Figure 21:
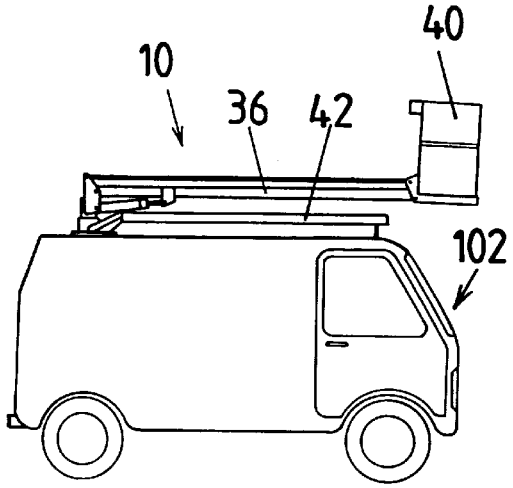
FIGS. 21 and 22 are similar views of the platform unit mounted on a van.
Figure 20:
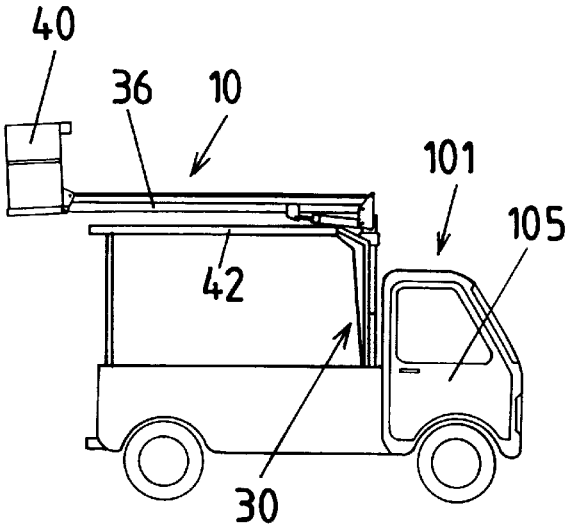
Figure 22:
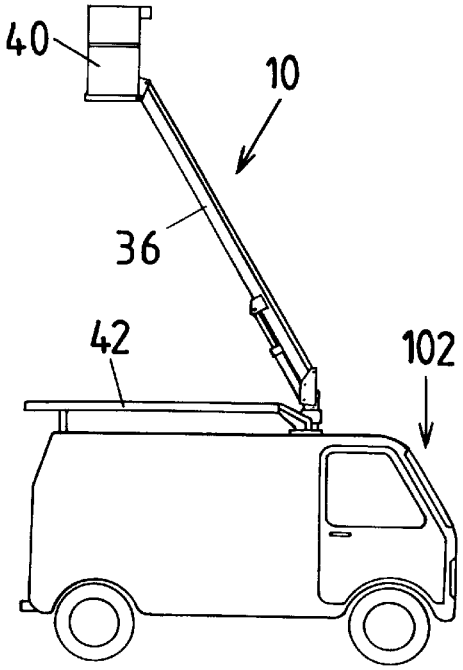

When the vehicle is not of sufficient heavy duty for transportation stability, the platform unit 10 may be mounted forwardly of the usual tow-bar point (see FIGS. 19 to 22). In the embodiments of FIGS. 19 and 20, the truck 101 may have the mast 30 mounted on the load bed and the counter leverage arm assembly 42 extending forwardly over the driver's compartment 105; or the mast 30 mounted immediately behind the compartment 105 and the counter leverage arm assembly 42 directed to the rear of the truck. For the van 102, the mast 30 may protrude through the roof and the counter leverage arm assembly 42 either extend to a forward or rearward bracing point (see FIGS. 21 and 22).

It will be preferred that the hydraulic system for the unit 10 will be driven via a pump powered by the vehicle's engine—the ram(s) 39, 39*a* and 52 can be connected by suitable quick-release hydraulic couplings.

To prevent the vehicle from moving while the platform unit 10 is in operation, the manual transmission gear lever 200 is fitted with a linkage arm 201 which engages an interlock switch 202 within the vehicle. The linkage arm 201 can only close the switch 202, to allow operation of the hydraulic pump, when the manual gearbox is in neutral. (For automatic transmissions, the switch 202 will only be closable with the gear selector is in "Park")

It will be readily apparent to the skilled addressee that the present invention provides a simple, yet efficient elevating work platform unit which can be readily mounted on, or demounted from, a transport vehicle which may require little, if any, modification, and which can be easily converted for other tasks.

Various changes and modifications may be made to the embodiments described without departing from the present invention.

What is claimed is:

1. A work platform unit to be mounted to a vehicle comprising:

a support frame;

a base frame, supporting a substantially vertical mast body;

a mast post rotatably supported by the mast body, the mast post supporting a boom for luffing or slewing movement relative to the base frame;

coupling means for enabling releasable coupling of the base frame to the support frame;

retractable stabilizing means positioned respectively adjacent each end of the base frame; and bracing means including diagonal braces between the base frame and an upper end of the mast body, and a counter leverage arm comprising a pair of L-shaped arms coupled to the base frame, each having a vertical leg extending along the mast body, a horizontal leg extending from the top of the vertical leg and extending away form the mast body and connected to a transversely extending cross-bar the base frame to the vehicle at a fixed point spaced along the longitudinal axis of the vehicle from the support frame, the bracing means providing vertical stability to the upper end of the mast body so that only vertical loads are applied by the work platform.

2. The unit as claimed in claim 1 wherein:

the base frame is a frame member arranged to extend substantially transversely to the longitudinal axis of the vehicle.

3. The unit as claimed in claim 2 wherein:

the frame member is a horizontal beam.

4. The unit as claimed in claim 1 wherein:

the coupling means includes a socket on the support frame releasably engageable by a complementary spigot or yoke on the base frame.

5. The unit as claimed in claim 1 wherein:

the boom is provided with a load engaging hook at its distal end;

the boom is selected from the group consisting of a fixed-length single boom, two-stage telescopic boom, fly boom and knuckle boom.

6. The unit as claimed in claim 1 wherein:

the boom is provided with a work platform at its distal end.

7. The unit as claimed in claim 1 wherein:

the boom is provided with a load engaging hook at its distal end.

8. The unit as claimed in claim 1 wherein:

the boom is hingedly mounted on the mast post and a hydraulic ram is operable to raise and lower the boom in a luffing movement.

9. The unit as claimed in claim 8 wherein:

a second hydraulic ram interconnects the mast post to the base frame to move the boom with a slewing movement.

10. The unit as claimed in claim 1 wherein;

said stabilizer means comprises a pair of stabilizers having extension means hingedly mounted on the base frame and a pair of jacks coupled to a first end of each of said extension means and a pair of feet coupled to a second end of each of said extension means.

11. A vehicle fitted with a work platform unit said work platform unit comprising:

a support frame;

a base frame, supporting a substantially vertical mast body;

a mast post rotatably supported by the mast body, the mast post supporting a boom for luffing or slewing movement relative to the base frame;

coupling means for enabling releasable coupling of the base frame to the support frame;

retractable stabilizing means positioned respectively adjacent each end of the base frame; and bracing means including diagonal braces between the base frame and an upper end of the mast body, and a counter leverage arm comprising a pair of L-shaped arms coupled to the base frame, each having a vertical leg extending along the mast body, a horizontal leg extending from the top of the vertical leg and extending away form the mast body and connected to a transversely extending cross-bar interconnecting the base frame to the vehicle at a fixed point spaced along the longitudinal axis of the vehicle from the support frame, the bracing means providing vertical stability to the upper end of the mast body so that only vertical loads are applied by the work platform.

12. The unit as claimed in claim 11 wherein:

the support frame is a tow-bar positioned at the rear of the vehicle.

13. The unit as claimed in claim 11 wherein:

the support frame is a load-deck of the vehicle.

14. The unit as claimed in claim 11 wherein:

the support frame is a chassis of the vehicle.

15. The unit as claimed in claim 11 wherein:

the support frame is positioned immediately rearwardly of an operator's cab at a front of the vehicle.

16. The unit as claimed in claim 11 wherein:

the vehicle is a van and an internal brace is provided between the floor and the roof of the van, the counter leverage arm being engageable with the internal brace.

* * * * *